United States Patent [19]

Nilgens et al.

[11] 3,973,739

[45] Aug. 10, 1976

[54] WINDING APPARATUS

[75] Inventors: Heinrich Nilgens, Budenheim; Karl Ostertag, Erlenbach; Herbert Scheiber, Kleinwallstadt, all of Germany

[73] Assignee: Akzona Incorporated, Asheville, N.C.

[22] Filed: Dec. 6, 1974

[21] Appl. No.: 530,348

[30] Foreign Application Priority Data

Dec. 21, 1973 Germany ..... 2363768

[52] U.S. Cl. ..... 242/18 R; 57/102; 57/129; 242/18 DD; 308/183

[51] Int. Cl.[2] ..... B65H 54/02; B65H 79/00

[58] Field of Search ..... 242/18 R, 18 DD, 18 G, 242/46.2, 46.4; 57/102, 135, 130, 129; 308/183; 82/28, 30

[56] References Cited

UNITED STATES PATENTS

| | | | |
|---|---|---|---|
| 610,970 | 9/1898 | McAlpine | 308/183 |
| 1,229,414 | 6/1917 | Clark | 308/183 X |
| 1,402,794 | 1/1922 | Reese | 82/30 X |
| 1,433,014 | 10/1922 | Kennedy | 308/183 |
| 2,781,628 | 2/1957 | Andrews et al. | 57/135 |
| 2,781,629 | 2/1957 | Winslow | 57/135 |
| 3,165,016 | 1/1965 | Woodle | 82/30 |
| 3,494,565 | 2/1970 | Mullins | 242/46.4 |
| 3,807,647 | 4/1974 | Miller | 242/18 DD |
| 3,813,051 | 5/1974 | Miller | 242/46.4 |

*Primary Examiner*—Stanley N. Gilreath
*Attorney, Agent, or Firm*—Johnston, Keil, Thompson & Shurtleff

[57] ABSTRACT

A high-speed winding apparatus for producing a filamentary spool package on a spool sleeve including spool holder means which engages the spool sleeve and which is rotatably mounted by means of a first set of anti-friction bearings onto a spool carrier which in turn is rotatably mounted by means of a second set of anti-friction bearings onto a support member. Drive means are provided to at least rotatably drive said spool holder means either directly or by a friction roll contacting the cylindrical surface of the spool package. The spool carrier is preferably also driven by a common or separate drive means at rotational speed proportionately slower than said spool holder means. The apparatus is especially useful for the take-up winding of filaments, threads, yarns or the like as employed in spin-drawing and high-speed spinning machines requiring linear winding speeds in excess of 5,000 meters/minute and spool revolutions of more than 30,000 rpm.

8 Claims, 5 Drawing Figures

WINDING APPARATUS

Figure 1:
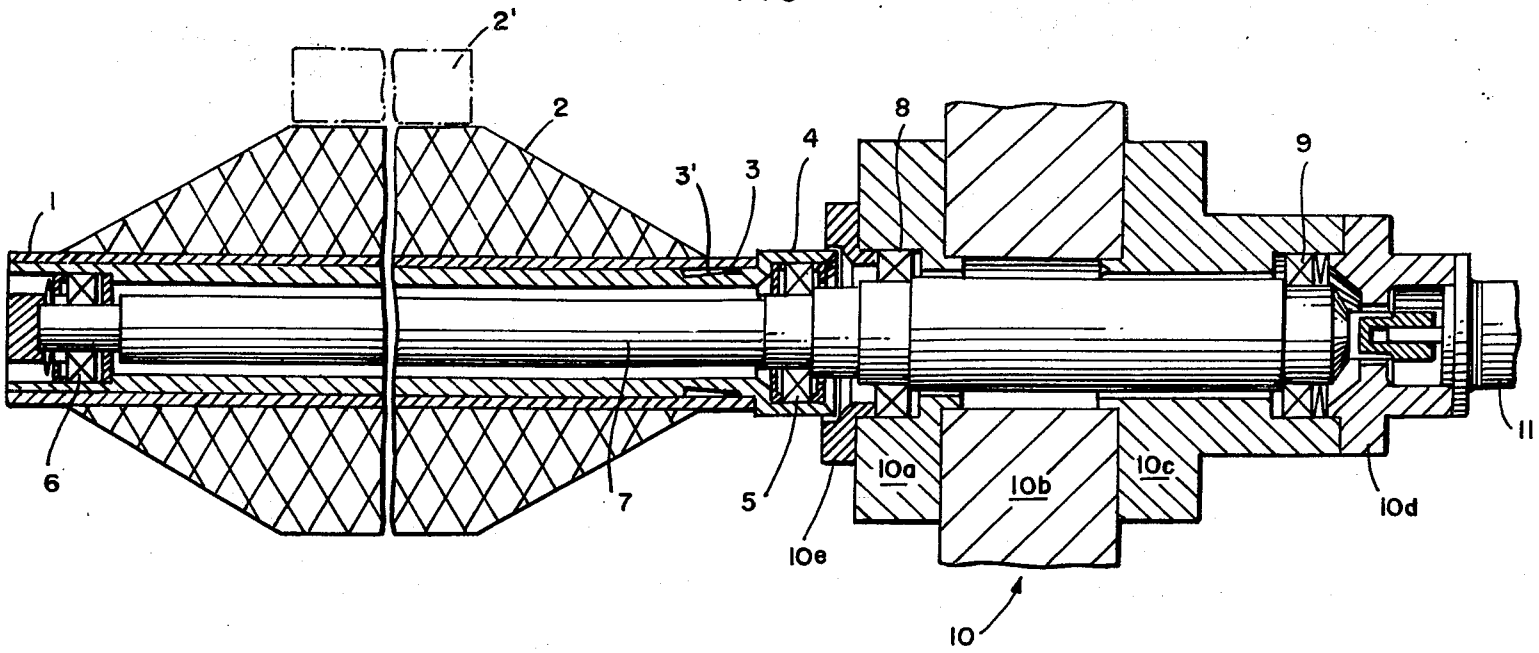

A spool winding device which utilizes ball bearings for rotatable support of a rotating spool carrier or holder is known from German Gebrauchsmuster Pat. No. 1,632,457. The maximum spool speed attainable with this arrangement is limited by the maximum permissible rotational speeds of the ball bearings as anti-friction bearing elements. If the rotational speed of the spool is increased beyond this point, the resulting excessive rotational speeds of the anti-friction bearing elements lead to a corresponding increase in wear and hence to a lowering of their life, provided that operation is possible at all. Such arrangements therefore are unsuitable as the take-up or winding apparatus of spin-drawing and high-speed spinning machines having very high linear filament or thread velocities which in turn require extremely high initial speeds of rotation of the spool.

It is an object of the present invention to provide a winding apparatus which permits winding with high velocities of at least 5,000 and preferably 6,000 to 12,000 meters per minute and more, based upon the development of desirable rotational speeds of the spool of approximately 40,000 to 80,000 revolutions per minute and more. It is also an object of the invention to provide a high-speed winding apparatus which simultaneously exhibits very high wear resistance and operational stability.

In accordance with the invention, it has now been found that a substantial improvement can be achieved in a winding apparatus for producing a filamentary spool package on a spool sleeve at high rotational speeds of the spool by providing in combination a spool holder means to interchangeably receive and engage the spool sleeve for rapid winding, a spool carrier on which the spool holder means is rotatably mounted through a first set of anti-friction bearings, and a supporting member on which the spool carrier is rotatably mounted through a second set of anti-friction bearings. The anti-friction bearings are preferably roller bearings in each of said sets. In operating the high-speed winder of the invention, a positive drive means must be applied at least to the spool package or the spool holder means in order to develop the required winding speeds. Preferably, however, the winding apparatus includes means to rotatably drive each of the spool holder means and the spool carrier at a different rate of speed, but normally in the same direction, with the carrier being driven proportionately more slowly than the spool holder means. In another especially preferred embodiment, the winding apparatus of the invention includes a spool holder means and a spool carrier which are coupled to a common drive means by separate power transmission means which in turn adjust the speed ratio between the spool holder means and the spool carrier.

Figure 2:
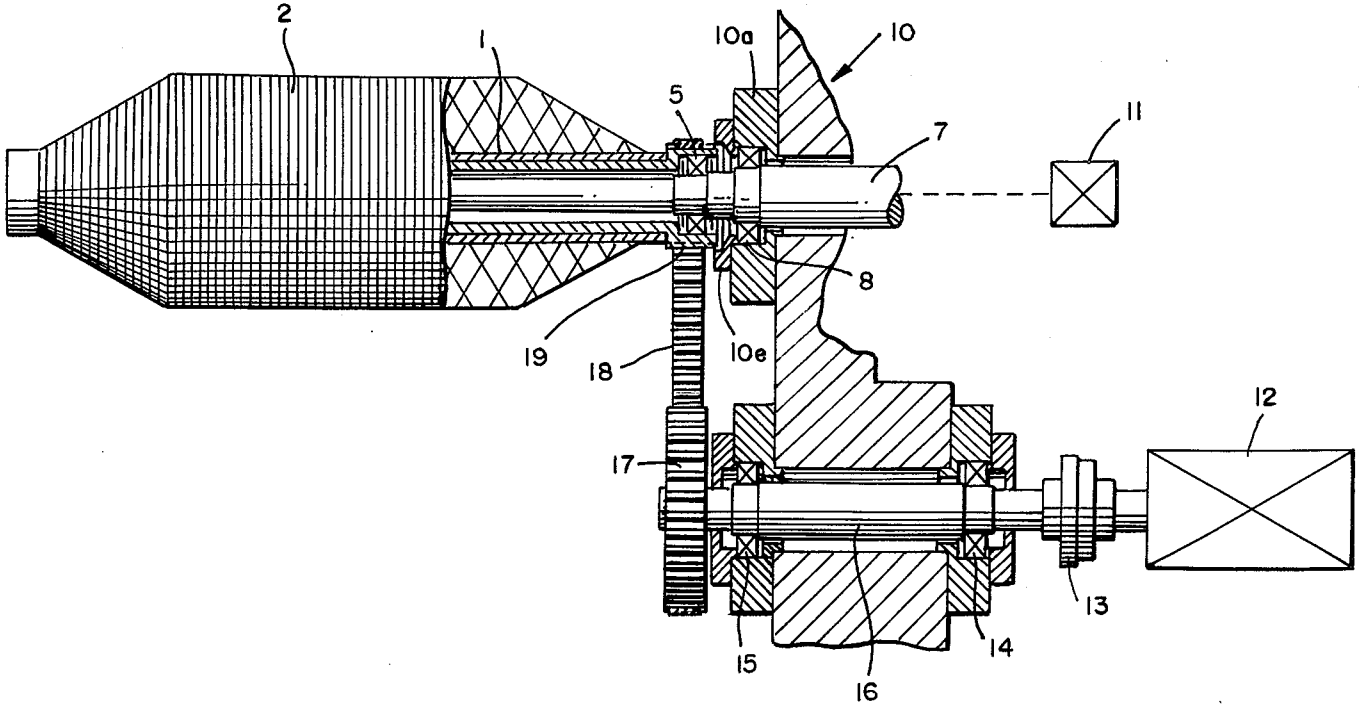
Figure 3:
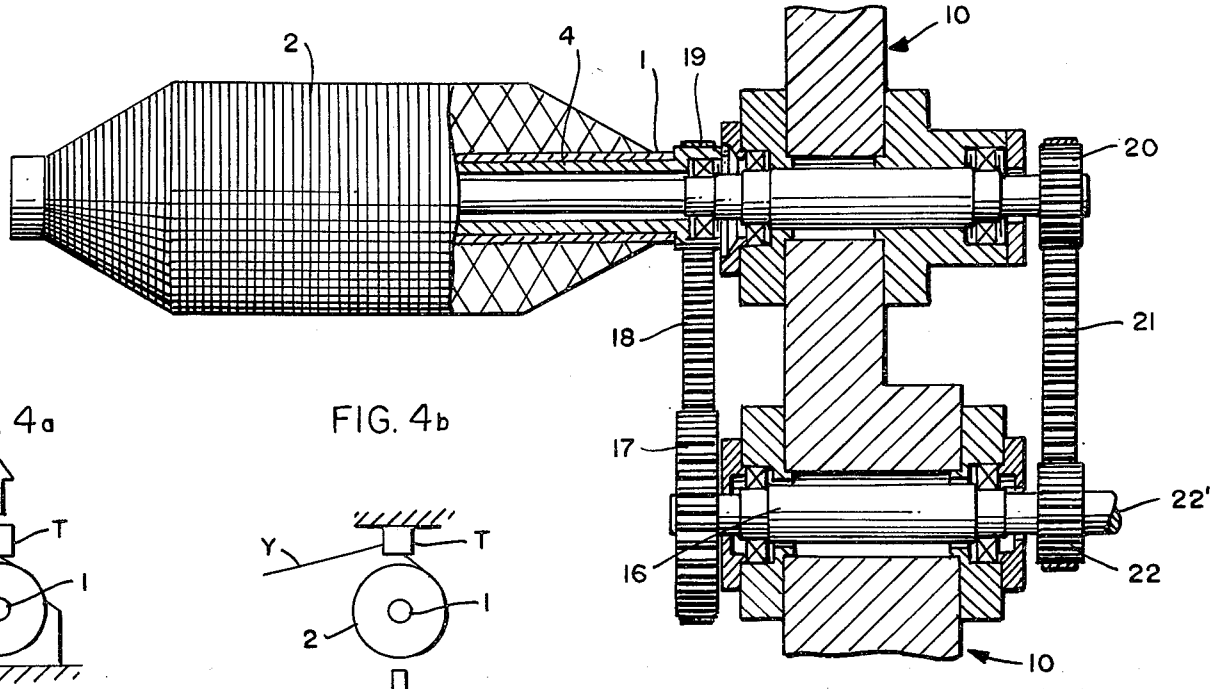
Figure 4B:
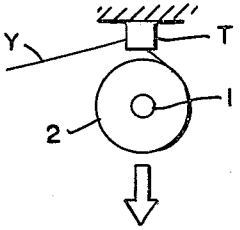
Figure 4A:
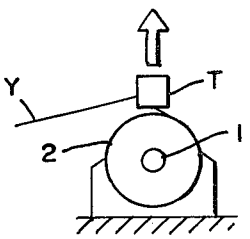

These and other features of the winding apparatus of the invention are explained in greater detail in the following specification describing several embodiments of the apparatus taken together with the accompanying drawings in which:

FIG. 1 is a partly schematic axial cross-section of a winding apparatus according to the invention in which a friction roll drive is applied to the developing spool package while an auxiliary motor is used to separately drive the spool carrier;

FIG. 2 is a similar partly schematic cross-section of another winding apparatus according to the invention in which the spool holder means is driven by a conventional variable speed motor through a belt and pulley drive linkage or connection; and FIG. 3 is another partly schematic axial cross-section of yet another winding apparatus according to the invention wherein the spool holder means and the spool carrier are proportionately coupled to a common rotating drive means;

FIGS. 4*a* and 4*b* schematically illustrate a spool mounted in a fixed axial position or with a movable axis, respectively, while a conventional traversing device is movable with respect to the fixed spool or stationary with respect to the movable spool.

The same reference numerals are used in the various embodiments of the drawings to identify identical or similar elements performing the same function in each case. Minor variations in structure or arrangement may be made without changing the essential function of the designated element.

In all of the FIGS. of the drawings, the sleeve 1 acts as a winding base or core for the spool or bobbin package 2 and is firmly but interchargeably engaged with the spool holder 4 by means of a clamping ring 3. This clamping ring 3 may be an elastic, resilient element which becomes wedged in the narrowing annular circumferential slot 3' of holder 4 so as to releasably grip the sleeve 1. Spool holder 4 is rotatably mounted by means of anti-friction bearings, preferably roller bearings 5 and 6, on the spool carrier 7 which in turn is mounted in its support 10 for free rotation by means of the roller bearings 8 and 9. Support member 10 can be made of a number of interconnected elements 10*a*, 10*b* and 10*c* for ease of assembly, including the flanged bearing closures 10*e* and 10*d*. In FIG. 1, the bobbin or spool package closures 10*e* and 10*d*. In FIG. 1, the bobbin or spool package 2 is driven by the friction roll 2' on its cylindrical surface by means of a conventional motor (not shown) which can be adjusted so that the roll 2' rotates at a constant circumferential velocity corresponding to a predetermined linear thread velocity. Spool carrier 7 has an auxiliary or independent drive of its own in the form of a compressed air motor 11 which partially compensates for the friction losses of the bearings and, as to order of magnitude, proportionately adjusts the rotational speed of spool carrier 7 in relation to its stationary support as well as to the spool holder 4 which in turn rotates about the spool carrier.

In FIG. 2, there is shown a winding apparatus with a directly driven spool holder 4, including a variable-speed electric motor 12 which is connected via clutch 13 to a transmission shaft 16 which is supported for rotation in the anti-friction bearings 14 and 15 and which in turn is operatively connected by means of a cooperating toothed pulley 17 and toothed belt 18 with a toothed rim 19 of the spool holder 4. If, as shown, a toothed pulley and belt is used to drive the spool holder 4, then the speed ratio between transmission shaft 16 and spool holder 4 should preferably be on the order of 1:2 so that the transmission shaft 16 rotates at approximately half the rotational speed of the spool holder 4. If desired, the free end of the spool carrier 7 may be driven, in analogy to FIG. 1, by means of a compressed air motor 11 in order to accelerate a build-up of the intermediate rotational speed of the carrier 7.

As soon as spool carrier 7 has adjusted itself to an intermediate rotational speed on the basis of the friction ratios of the anti-friction bearings as between the spool holder 4, the spool carrier 7 and the support member 10, the relative rotational speeds of anti-friction bearings 5, 6 of the spool holder 4 assume a value or magnitude which approximates the speeds of the anti-friction bearingss 8, 9 and 14, 15. Thus, the rolling speeds of the anti-friction rolling elements of all bearings relatively to their races are largely equalized once the winding apparatus has reached full speed at the beginning of the winding operation.

The most accurate speed adjustment for a maximum increase in the speed of the spool holder and, at the same time, the optimum utilization of the available wear resistance of the employed sets of anti-friction bearings may be achieved by coupling the spool holder 4 with the spool carrier 7 to a common drive by means of a power transmission arrangement, e.g. using different gearings from a common drive or transmisssion shaft. An example for this arrangement is shown in FIG. 3. The transmission assembly consists of two pulley and belt drives, one of which 17, 18, 19 has previously been described in connection with the motor drive of spool holder 4 as shown in FIG. 2, while the other consists of the toothed pulley 20 mounted on the right-hand end of spool carrier 7, the toothed belt 21 and the opposite toothed pulley 22 mounted on the transmission shaft 16 which also carries toothed pulley 17. These toothed pulley and belt drives are designed so that the speed ratio between the transmission shaft 16 and spool carrier 4 is preferably about 1:2 while the speed ratio between transmission shaft 16 and spool carrier 7 is preferably about 1:1.

The broken off or free end 22' of transmission shaft 16 as shown in FIG. 3 is intended to indicate that it is also possible to connect this specific shaft to an auxiliary drive motor, to a principal drive means or to a speed-varying transmission in the drive motor. An auxiliary drive, such as a compressed air motor 11 as employed in FIG. 1, is useful in case the bobbin or spool 2 is driven by means of the friction roll 2', particularly in order to relieve the bobbin from forces required for the drive of the transmission and of the spool carrier.

A principal or main drive using a variable speed motor for driving the bobbin or spool through the medium of the spool holder has already been shown in FIG. 2. If a constant speed motor is used for the axial drive of the bobbin 2, which must rotate more slowly as its diameter increases to maintain a constant feed or linear velocity of the thread or yarn, then it is also possible to connect a speed-changing transmission to the end of the drive shaft, for example using a transmission or clutch of the friction type. In all of these cases, the desired speed ratio between spool holder 4 and spool carrier 7 is maintained by means of the toothed belt drive 20, 21, 22.

According to the invention, the problem of maintaining high winding speeds is essentially solved in a winding apparatus of the type described above by rotatably supporting a spool carrier such as the cantilevered spindle 7 in its support 10 by means of one set of anti-friction bearings and then further rotatably supporting a spool holder 4 on this carrier or spindle 7 by means of another set of anti-friction bearings. In the known winding apparatus, the revolving speed of anti-friction bearing elements is determined by the fact that the spool holder revolves with a predetermined speed while a spool carrier or supporting means is stationary. In the device according to the invention, on the other hand, the relative speed of revolution of the anti-friction bearing elements supporting the spool holder 4 decreases, for any given rotational speed of the spool holder, as the spool carrier or spindle 7 is put in motion in the same direction of rotation as the spool holder. Alternatively, if the speed of revolution of the anti-friction bearing elements is assumed to be constant, then the rotational speed of the spool holder 4 may be increased as the spool carrier 7 is put into rotary motion in the same direction of rotation as the spool holder. In general, for a given design and wear resistance of the anti-friction bearing elements, one can achieve almost twice the winding speed of conventional machines.

If the spool carrier 7 does not have a drive of its own but is mounted for free rotation in its support 10, then it is rapidly put into rotary motion by the bearing friction of the rotating spool holder 4, particularly if the bearings have to transmit a considerable amount of contact pressure resulting from a friction roll drive in contact with the bobbin. It takes only a short time for the reduction in rotational speed of the initially highly loaded anti-friction bearing elements to become effective. In some cases, however, it will be most desirable to provide an independent or coupled rotary drive for the spool carrier 7. In this manner, there is a partial compensation for the bearing friction losses so that the bobbin or spool holder is required to transmit less driving energy and hence is subject to less stress. In addition, at the beginning of the winding operation where the speed of rotation is naturally at a maximum, the compensating rotational speed of the spool carrier is fully available for reducing the rotational speed of the anti-friction bearings which carry the spool holder 4 on the spool carrier or spindle 7. This compensating or auxiliary drive of the spool carrier is most conveniently achieved by a compressed air motor connected directly to the spool carrier as indicated in FIGS. 1 and 2.

If the spool is to be driven from its axis by the spool holder, rather than by a friction roll imparting a constant circumferential winding speed, then one adopts the modifications of FIGS. 2 or 3 where the spool holder is connected or linked with a rotary drive. For the purpose of maintaining a constant circumferential winding velocity during the winding operation, this rotary drive may be provided with a motor control or regulating means, known per se for varying the rotational speed so that it gradually decreases as the bobbin diameter increases.

The most advantageous embodiment of the invention is that of FIG. 3 wherein the spool holder 4 and the spool carrier 7 are coupled with each other by a transmission or speed-proportioning arrangement. In this manner the rotational speed ratio of the spool holder to the spool carrier becomes fixed (for example at about 2:1) rather than being left to chance. However, the speed ratio of holder to carrier need not always be constant during the winding operation. Instead, this ratio may also be varied in accordance with a predetermined pattern. The control or regulating means suitable for varying the transmission ratios are generally known and therefore need not be described in detail.

Where the winding apparatus of the invention is provided with a speed-changing or transmission arrangement as in FIG. 3, the individual drive of the spool carrier or spool holder can be dispensed with if the device is designed for axially driving the spool and if either the spool holder or the spool carrier is provided with the principal or main drive means.

On the other hand, where the winder equipped with a speed-changing or transmission arrangement is designed for a friction roll drive on the bobbin surface, then in order to provide relief for the bobbin in connection with its friction drive, it is most preferred to additionally drive the spool carrier from its axis.

As shown in FIGS. 4*a* and 4*b*, the high-speed winder according to the invention may be mounted for rotation in a stationary support (FIG. 4*a*) in which case a filament traversing device T moves outwardly as the bobbin diameter increases, or the winder may be mounted in a support which is capable of outward movement with respect to the stationary member, the traversing means T then also being stationary (FIG. 4*b*). Both of these arrangements are conventional in winding machines where the thread or yarn Y is guided by the traversing means T as it is taken up on the spool of the winder.

The use of an outwardly movable traversing means T is generally preferred for purposes of the present invention together with the preferred independent or coupled drive of both the spool carrier or spindle and the spool holder. When the high-speed winding apparatus combines these various features, it attains not only very high operational speeds but it also is readily adaptable to different winding conditions while providing the maximum reduction in wear on bearing elements. Smooth and trouble-free operation of the high-speed winder can then be maintained over long periods of time with reasonable maintenance and servicing.

The invention is hereby claimed as follows:

1. In a winding apparatus for producing a filamentary spool package on a spool sleeve at high rotational speeds of the spool, the improvement which comprises:

a spool holder means to interchangeably receive and engage said spool sleeve on a horizontal axis for rapid winding;

a spool carrier on which said spool holder means is rotatably mounted through a first paired set of anti-friction bearings;

a multi-element assembled supporting member on which said spool carrier is cantilevered and rotatably mounted only at its inboard end, which extends axially from said spool holder means, through a second paired set of anti-friction bearings, each set of bearings being contained in a separately assembled element adjacent either end of said supporting member; and means for driving said spool carrier relative to said spool holder means at a rate proportionately slower than said spool holder means.

2. A winding apparatus as claimed in claim 1 wherein said anti-friction bearings are roller bearings in each of said sets.

3. A winding apparatus as claimed in claim 1 wherein said driving means includes a friction roll drive placed in direct rolling contact with the spool package being formed.

4. A winding apparatus as claimed in claim 1 wherein said driving means includes a rotary drive assembly operatively connected to said spool holder means for high speed rotation of the spool package being formed.

5. Winding apparatus as claimed in claim 1 wherein said driving means includes means operatively connected to rotate only said spool holder means with said spool carrier being mounted for free rotation, said spool carrier being rotated by means of the frictional bearing force imparted by the first set of anti-friction bearings.

6. Winding apparatus as claimed in claim 1 wherein said driving means includes a separate transmission means for said spool holder means and said spool carrier and a common drive means coupled to each said transmission means.

7. Winding apparatus as claimed in claim 1 wherein said supporting member for said spool carrier and said spool holder means is mounted in a fixed position to provide a stationary spool axis and a filament traversing device is mounted to move outwardly from said stationary spool axis with increasing diameter of the spool package.

8. Winding apparatus as claimed in claim 1 wherein a filament traversing device is fixed for traversing movement in a stationary plane with the supporting member for said spool carrier and said spool holding means being mounted for movement of the spool axis outwardly from the fixed traversing device as the diameter of the spool package increases.

* * * * *